US006461218B1

(12) United States Patent
Mullaney et al.

(10) Patent No.: US 6,461,218 B1
(45) Date of Patent: Oct. 8, 2002

(54) REMOTELY CONTROLLED TOY MOTORIZED SNAKE

(75) Inventors: Sean T. Mullaney; Michael G. Hoeting, both of Cincinnati, OH (US); Frederick B. Robjent, Orchard Park, NY (US)

(73) Assignee: Fisher-Price, Inc., East Aurora, NY (US)

( * ) Notice: Subject to any disclaimer, the term of this patent is extended or adjusted under 35 U.S.C. 154(b) by 0 days.

(21) Appl. No.: 09/780,250

(22) Filed: Feb. 9, 2001

(51) Int. Cl.[7] ..... A63H 3/20
(52) U.S. Cl. ..... 446/330; 446/272; 446/274
(58) Field of Search ..... 446/272, 274, 446/276, 278, 287, 289, 290, 352, 353, 368, 456, 454, 330; 180/14.1, 24.01, 14.03, 235; 280/1.203, 827

(56) References Cited

U.S. PATENT DOCUMENTS 4,417,523 A * 11/1983 Mariol ..... 105/1 T
4,674,585 A * 6/1987 Barlow et al. ..... 180/14.1
4,680,022 A * 7/1987 Hoshino et al. ..... 446/487
4,698,044 A * 10/1987 Kennedy et al. ..... 446/434
5,474,486 A 12/1995 Chilton et al.

* cited by examiner

*Primary Examiner*—Derris H. Banks
*Assistant Examiner*—Jamila Williams
(74) *Attorney, Agent, or Firm*—Akin, Gump, Strauss, Hauer & Feld, L.L.P.

(57) ABSTRACT

A motorized snake includes a chassis having a front end and a rear end with at least one ground contacting drive wheel. A neck is pivotally coupled with the front edge of the chassis to pivot forward and back. A head portion, which includes eyes and an extending tongue, is pivotally connected to the front portion of the neck. A multi-section tail including a trailer and at least one follower is coupled with the rear end of the chassis. The trailer has at least one ground contacting wheel and is coupled with the rear end of the chassis to pivot side to side on the rear end of the chassis. The one or more followers are coupled with the rear end of the trailer in a chain to pivot side to side on the rear end of the trailer. A motor or other prime mover in the chassis is drivingly coupled with the drive wheel to rotate the wheel to propel the snake and simultaneously with the neck so as to move the neck forward and back on the front end of the chassis, and also with the trailer so as to move the trailer side to side on the rear end of the chassis.

8 Claims, 9 Drawing Sheets

REMOTELY CONTROLLED TOY MOTORIZED SNAKE

BACKGROUND OF THE INVENTION

The invention relates to powered toy vehicles and, in particular, to vehicles designed to mimic the movement of an animal.

BRIEF SUMMARY OF THE INVENTION

A motorized snake comprising a chassis having a front end and a rear end; at least one ground contacting drive wheel mounted on the chassis; a neck pivotally coupled with the front end of the chassis to pivot forward and back; a multi-section tail including a trailer and at least one follower, the trailer having at least one ground contacting wheel and being coupled with the rear end of the chassis to pivot side to side on the rear end of the chassis, the follower being coupled with the rear end of the trailer distal to the chassis to pivot side to side on the rear end of the trailer; and a motor in the chassis, the motor being drivingly coupled with the at least one drive wheel to rotate the drive wheel to propel the snake and simultaneously with at least one of the neck and the trailer so as to move the neck forward and back on the front end of the chassis or so as to move the trailer side to side on the rear end of the chassis or both.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
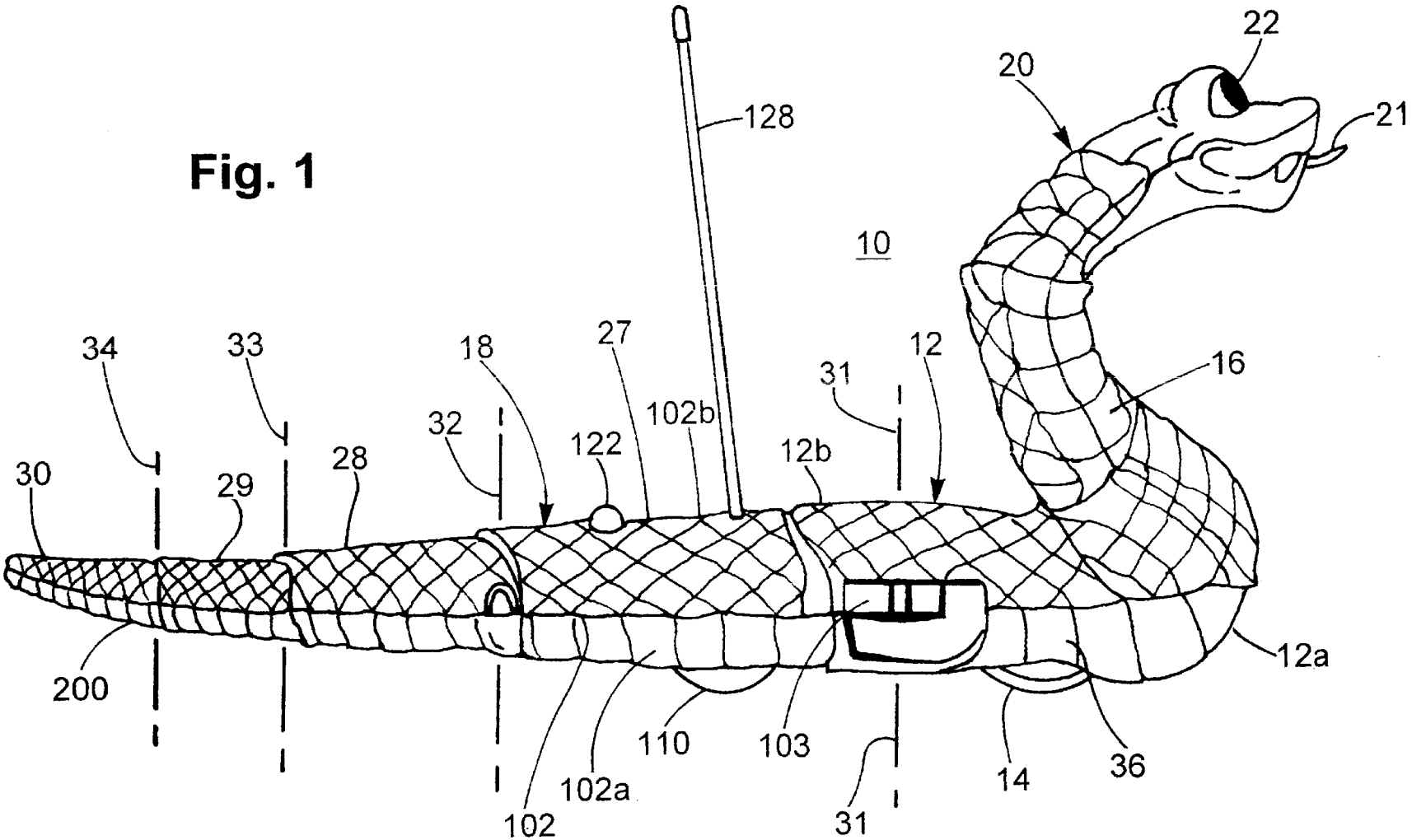
FIG. 1 is a is a side elevation view of a motorized snake of the present invention moving forward.
Figure 2:
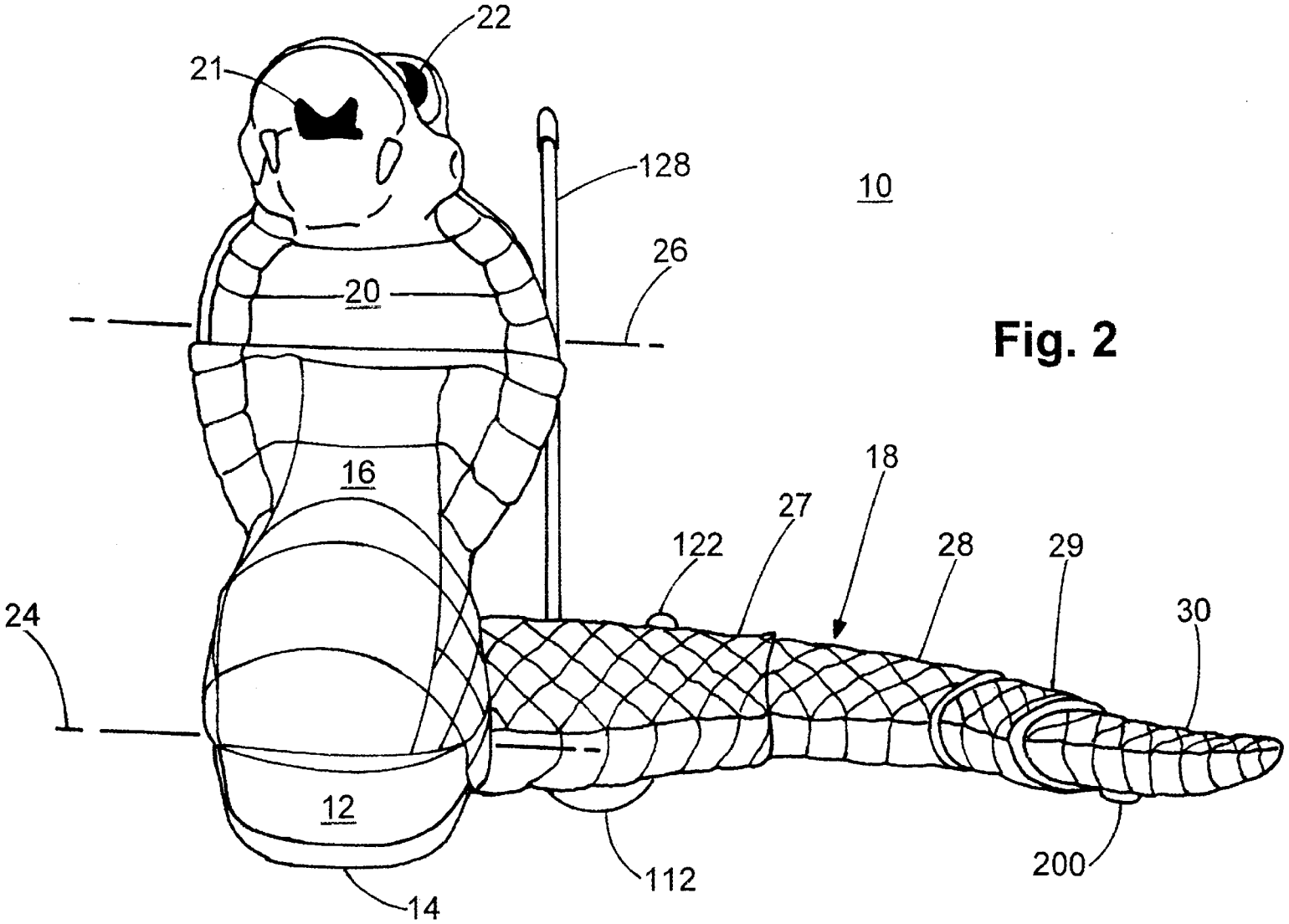
FIG. 2 is a is a perspective view of the FIG. 1 snake reversing in direction.

In the drawings, like numerals are used to indicate like elements throughout. A remotely controlled toy motorized snake 10 is depicted in FIGS. 1 and 2. Generally speaking, the snake 10 includes a motorized chassis 12 with a front end 12*a,* a rear end 12*b* and at least one ground contacting drive wheel 14. Snake 10 further includes a "neck" 16 pivotally coupled with the front end 12*a* of the chassis 12 to pivot forward and back and a "head" 20 pivotally coupled with the neck 16 at the end distal to the chassis 12. The snake 10 further includes a multi-section "tail" 18 pivotally coupled with the rear end 12*b* of the chassis 12. The head 20 includes a tongue 21 which may be driven to extend and retract as the snake 10 moves. The head 20 further includes eyes 22, which may be formed from light emitting diodes or other small light sources, and which can be controlled to illuminate when the snake 10 moves in a desired way. The snake's neck 16 and head 20 are mounted so as to pivot about parallel horizontal neck 24 and head 26 axes, respectively. The tail 18 is formed by four tail sections 27–30. First tail section 27 is the largest and is pivotally coupled through a vertical axis 31 with the rear end 12*b* of chassis 12. Each subsequent tail section 28–30 is received in the distal end of the proceeding tail section 27–29 and is also coupled to pivot about a vertical axis 32–34, respectively. Chassis 12 and first tail section 27 interact with one another in the manner of a tractor and trailer, respectively, and the first tail section 27 will also be referred to as the trailer 27. The remaining tail sections 28–30 will also be referred to as followers 28–30.

FIG. 1 shows the configuration of the snake 10 in its normal forward moving condition.

FIG. 2 illustrates the snake 10 after its motor 40 has been operated to drive the snake 10 in reverse. As can be seen, the tail 18 is effectively jack-knifed behind the chassis 12. As the snake 10 is driven further backwards, the drag of the jack-knifed tail 18 causes the chassis 12 to press against the trailer 27, causing it to pivot more quickly. Eventually, the tail 18 drags on the chassis 12 causing the rear end 12*b* of the chassis 12 to turn towards the trailer 27 and rest of the tail 18, causing the chassis 12 to turn on its drive wheel 14. This changes the direction in which the chassis 12 faces, effectively allowing the snake 10 to be turned.

Figure 3:
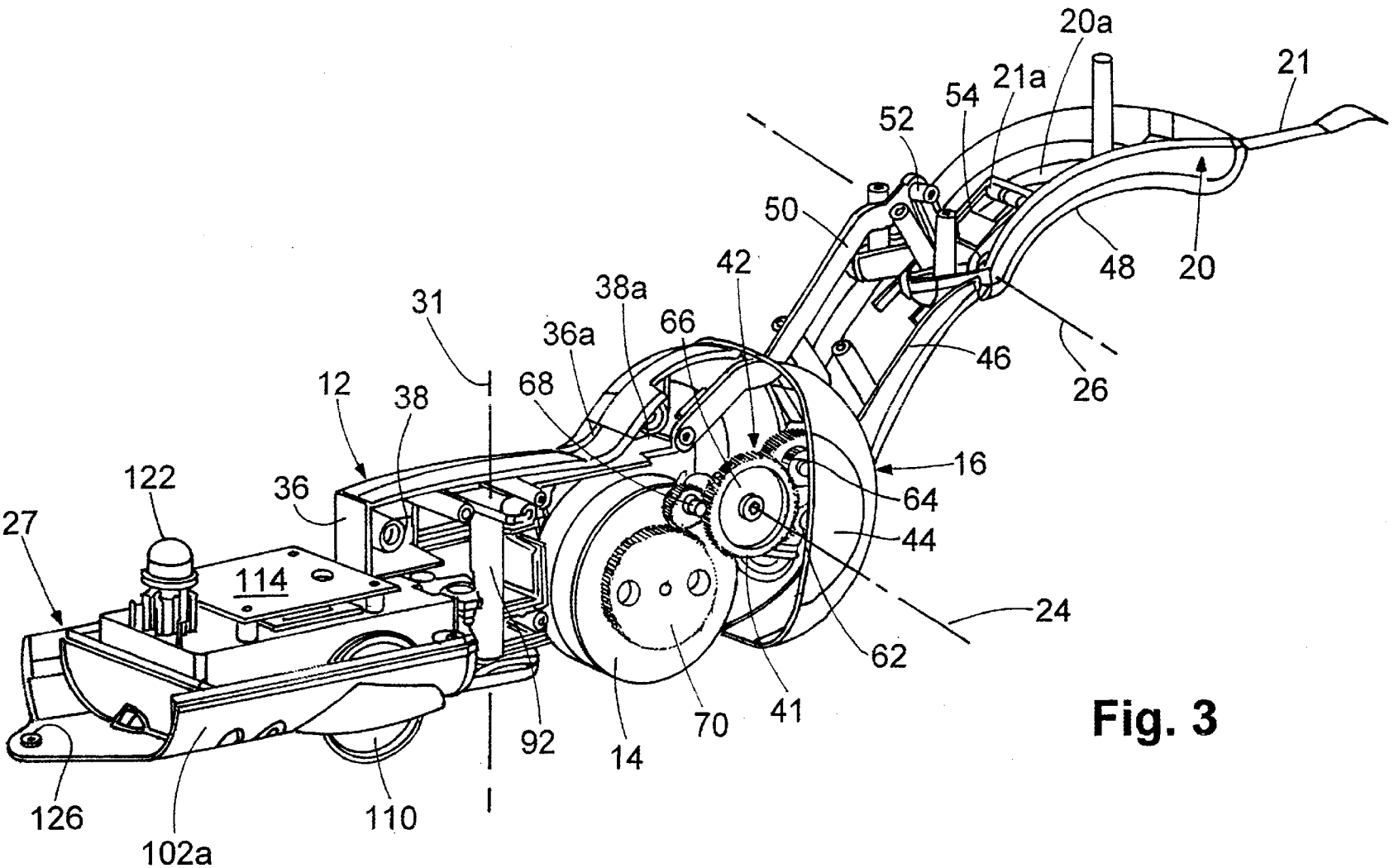
FIG. 3 is a right rear perspective view of a front portion of the snake with part of the outer covering removed to reveal the mechanical linkages to the neck and head from the chassis.

The chassis 12 is shown in greater detail in FIGS. 3–6. FIG. 3 shows the chassis 12 with the neck 16, head 20 and trailer 27 with portions of their outer covers removed. As seen in FIG. 1, the chassis 12 includes an outer cover 36 formed by a pair of interfitting outer shells one of which is indicated at 36*a* and an inner housing 38 also formed by a pair of interfitting inner shells one of which is indicated at 38*a*. An electric motor 40 and associated reduction drive train indicated generally at 42 are mounted in the inner housing 38. The neck 16 includes a lower, generally semi-cylindrical shell 44 from which extends an elongated, rigid, lower housing member 46. An elongated, rigid, lower housing member 48 of the head 20 is pivotally coupled to the distal end of the neck member 46 so as to pivot on neck axis 24. A link 50 is pivotally attached to the inner housing shell 38 at its proximate end and is pivotally connected at its distal end to another link 52, which is fixedly coupled with the head member 48 and is also mounted for rotation on the head axis 26. Link 50 is attached to pivots on the chassis 12 (inner housing 38) and the head 20 that are spaced away from the pivot axes 24, 26 at which the neck 16 is pivotally coupled with the chassis 12 and the head 20 so as to lever the head 20 when the neck moves. Tongue 21 is mounted in a slot in the interior of head 20. The innermost end 21*a* of tongue 21 is received in a holder in the distal end of an arm 54 extended from the remainder of the neck member 46 into the head 20, which slides the tongue 21 in and out of the head 20 as the neck 16 and head 20 are moved from an initial, generally upright position shown in FIGS. 1 and 2 to a forward extending position shown in FIG. 3.

Figure 4:
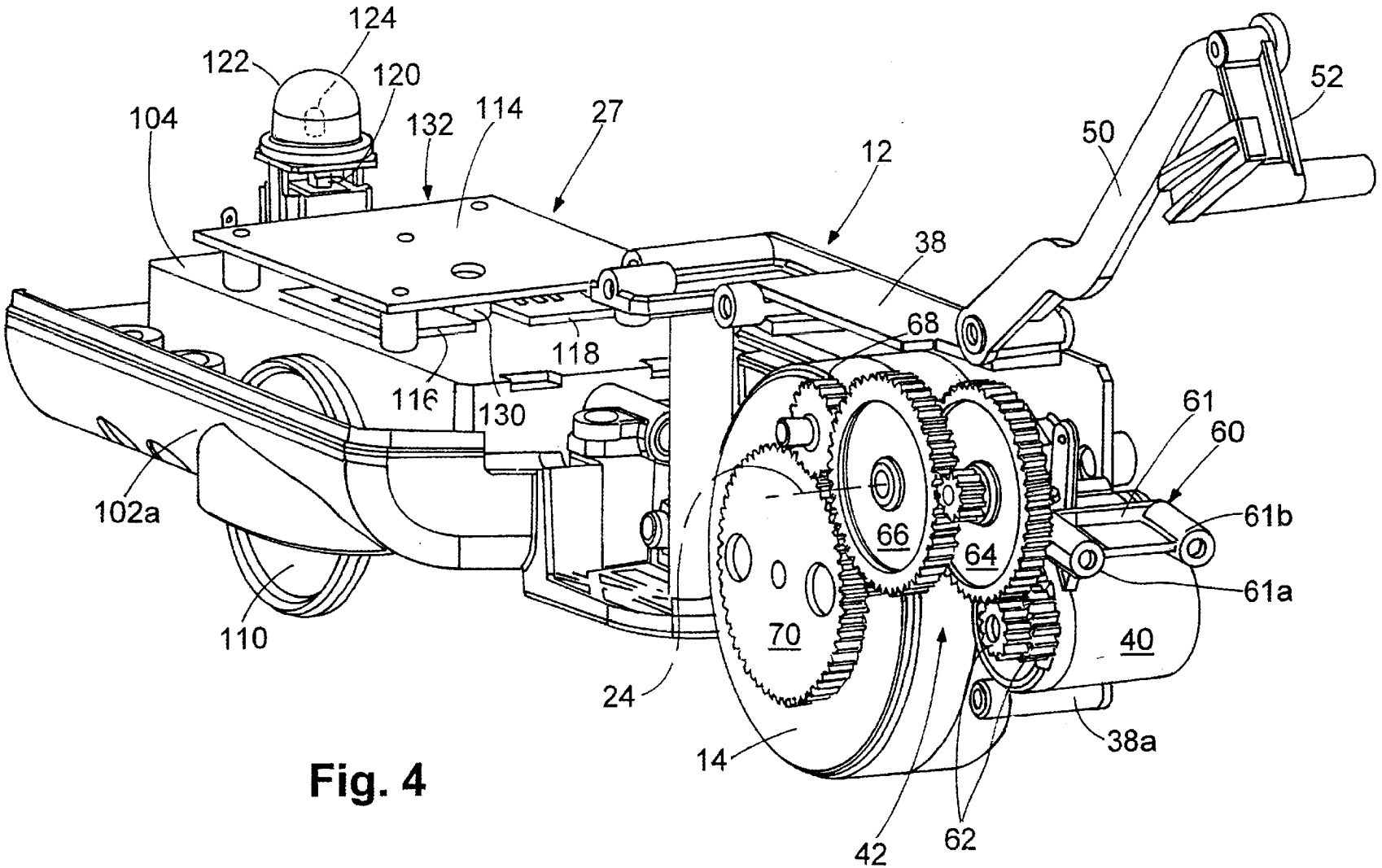
FIG. 4 is a lower right front perspective view of the chassis with more of the outer cover removed.
Figure 5:
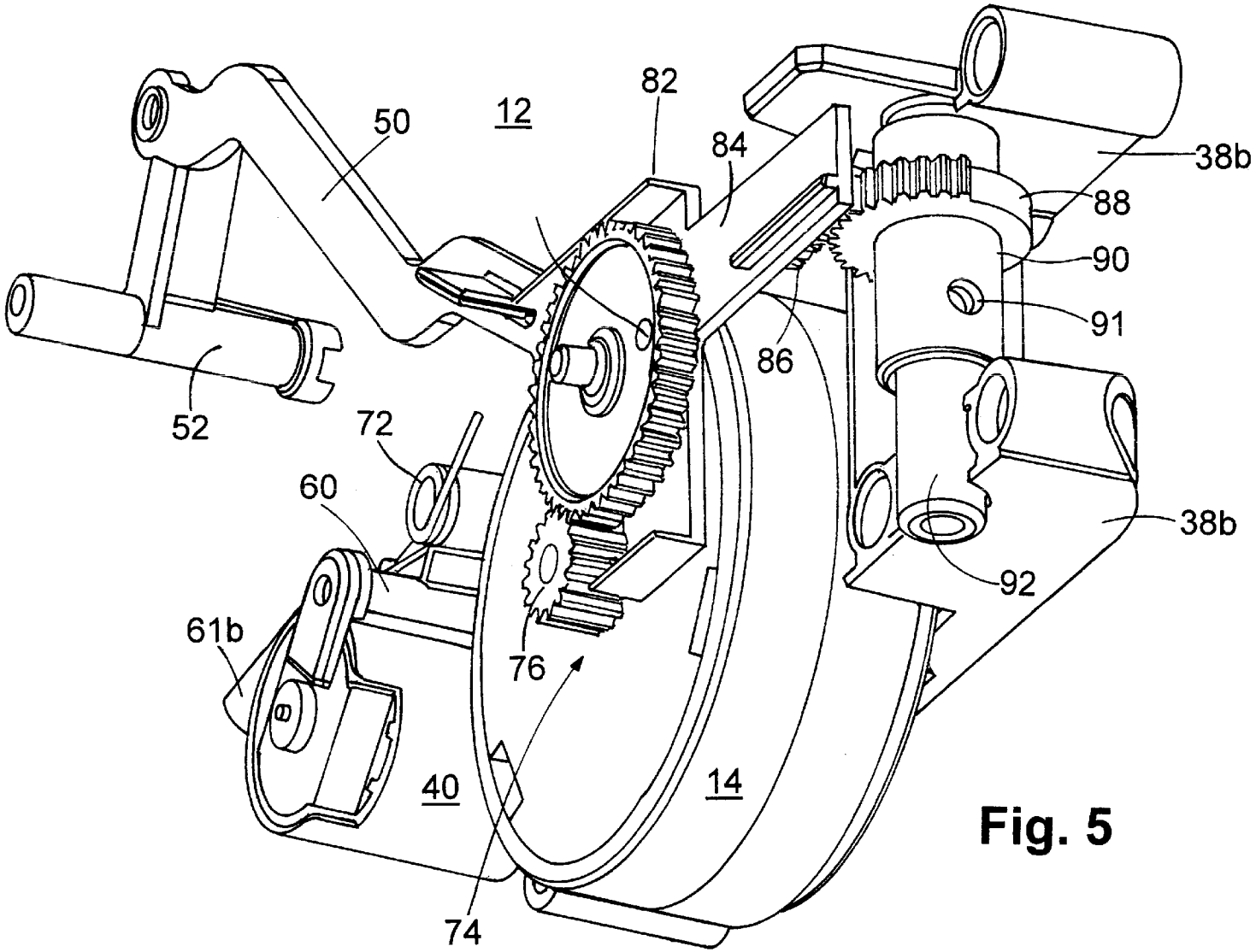
FIG. 5 is a lower left rear perspective view of the chassis with more of the covering removed.

The neck 16 is caused to rock forward and back on the chassis 12 by means of a rocker arm 60, the forward portion 61 of which can been seen in FIG. 4. Forward portion 61 includes a pair of posts 61*a,* 61*b,* which receive a pair of fasteners such as screws passed through the lower semi-cylindrical shell 44 to couple the shell 44 to the rocker arm 60. Rocker arm 60 is mounted to pivot about the neck axis 24. In addition to the semi-cylindrical shell 44, rocker arm 60 also supports motor 40, a first combination reduction gear 62 and a second combination reduction gear 64. All three elements 40, 62 and 64 can rock on rocker arm 60 about neck axis 24. A pinion 41 (FIG. 6) on the motor 40 engages the larger inner gear of combination reduction gear 62. As seen in FIG. 4, the second, outer, smaller gear of combination reduction gear 62 engages the larger inner gear of combination reduction gear 64 with the smaller outer gear of combination reduction gear 64 engaging the single reduction gear 66 which is mounted between inner housing shell 38*a* and the opposing shell (38*b,* not depicted) to rotate about neck axis 24. Reduction gear 66 is engaged with an idler gear 68 which drives yet another gear 70 fixed to the drive wheel 14 to rotate that drive wheel 14. Rocker arm 60 is mounted to pivot through an arc of about sixty to eighty degrees between upper and lower contact points on the inner housing 38. Referring to FIG. 5, the position of rocker arm 60 is preferably biased by a suitable bias member 72 such as a torsion coil spring to its uppermost or nearly uppermost (i.e. FIGS. 1 and 2) position.

By virtue of its pivotal mounting and its coupling to reduction gear 66 through the small gear of combination reduction gear 64, rocker arm 60 and the mounted drive train 42 components including motor 40 and combination reduction gears 62 and 64 all rotate about reduction gear 66 on the smaller gear of the combination reduction gear 64. When the motor 40 is activated to drive the drive wheel 14 in a forward direction, initial drag on the drive wheel 14 resists rotation and transfers that drag to reduction gear 66. As a result, combination reduction gear 64 rotates in a clockwise direction as viewed in FIGS. 3 and 4 and tries to climb up reduction gear 66. If bias member 72 does not press rocker arm 60 hard against the inner housing 38, rocker arm 60 will oscillate between its neutral, near upright position and a full upright position hard against the upper stop of inner housing 38 causing the snake's head 20 and neck 16 to rock forward and back slightly during forward movement of the snake 10. When the motor 40 is driven in the opposite direction, combination reduction gear 64 rotates in a clockwise direction and down around reduction gear 66 until the drag from the drive wheel 14 is overcome or until the rocker arm 60 hits the bottom stop on the inner housing 38, whichever occurs first. As the neck 16 is rotated about the neck axis 24, link 50 is effectively thrust forward at its distal end and pivots the head 20 forward about head axis 26, causing the head 20 and the tongue 21 to be thrust forward, the tongue 21 moving further out of the snake's head 20. When the neck 16 is pitched down and forward to its lowermost position, all power from the motor 40 is transferred to the drive wheel 14 to accelerate the drive wheel 14. As it accelerates, its inertia causes it to rotate slightly faster than combination reduction gear 64, permitting the rocker arm 60 to rotate up (counterclockwise in FIG. 3) on the reduction gear 66. In this way the head 20 and neck 16 oscillate up and down in a pronounced way.

Figure 6:
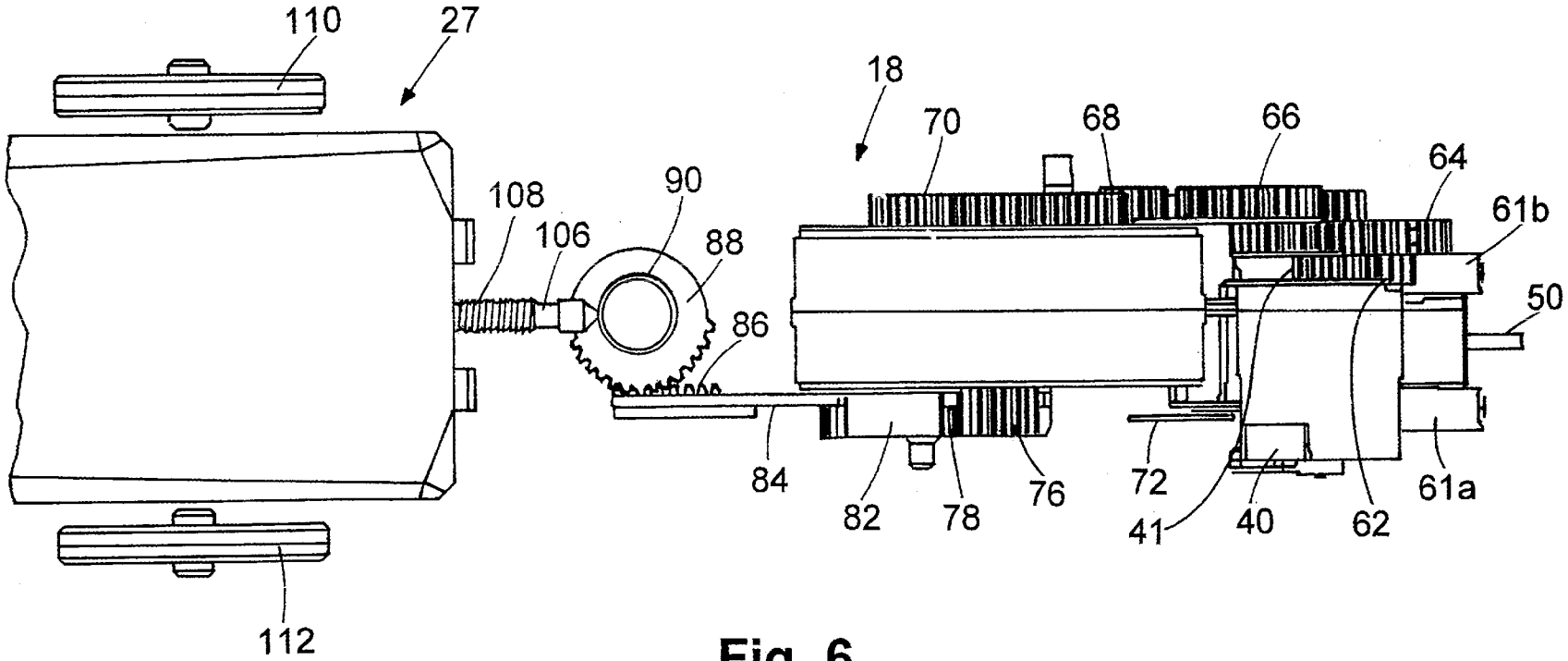
FIG. 6 is a top plan view of the chassis drive train and coupling with the trailer with the coverings of the chassis and trailer removed.

Referring now to FIG. 5, the opposite side of chassis 12 is shown with inner housing shell 38*a* of inner housing 38 removed to reveal a take-off drive 74 from the drive train 42 and the trailer 27. A small gear 76 is fixed to the drive wheel 14 to rotate with the drive wheel 14 and drive an eccentric gear 78. The eccentric 80 on gear 78 is engaged with and drives a shuttle frame 82, which is mounted in the inner housing 38 to be cycled back and forth within the inner housing 38. The shuttle frame 82 supports a rearward extending arm 84 with rack 86. Rack 86 is engaged with a gear segment 88 mounted on a collar 90 which, in turn, is mounted on a hollow vertical pivot pin 92. Collar 90 includes a detent 91, the use of which is best seen in FIG. 6. A spring 108 biases the tip of an engagement pin 106 in the trailer 27 against collar 90 to engage the detent 91. In this way, the trailer 27 is mechanically engaged with the chassis 12 to be swung or oscillated side to side behind the chassis 12. This side to side oscillating motion of the trailer 27 is passed by the pivot connection 32 from the trailer 27 to the adjoining follower 28 and through the pivot connections 33–34 to each subsequent follower 29–30. Elements 82, 84, 86, 88 and 90 have been omitted from FIGS. 3 and 4 for clarity of the other elements.

The trailer 27 is preferably further provided with a pair of free-rotating, ground-contacting wheels 110 and 112, which can be seen in various figures. Referring to FIGS. 1, 3 and 4, the trailer 27 further includes an outer housing 102 formed by a pair of interfitting shells, a lower shell of which 102*a* is shown. The trailer further includes an inner housing 104 (see FIG. 4), which is intended to receive a battery power supply (not depicted). An access door (also not depicted) is provided on the lower side of the outer housing 102. The inner housing 104 supports circuitry indicated generally at 132 in the form of a printed circuit board 114 and some other discrete circuit members 116, 118. A push-push, on/off switch 120 is mounted on the rear of the inner housing 104 and supports a cover 122 with LED 124 (in phantom), which is illuminated by the circuitry 132 when the switch 120 is on. Antenna 128 (see FIGS. 1 and 2) is extended upwardly from a base 130 (see FIG. 4) and is preferably formed by a thin flexible length of wire in a soft flexible plastic tube.

The lower outer housing shell 102*a* supports an upward extending circular boss 126 on its rearmost end which forms part of a pivot coupling between the rear of trailer 27 and the next follower 28. A similar boss is provided on the upper shell (neither depicted) of the outer housing 102. The bosses are received in openings in the upper and lower sides of the outer shell of the second tail section 28. The third tail section 29 is similarly pivotally coupled to the rear end of second tail section 28 as is final tail section 30 to third tail section 29. A similar boss on the front tongue of lower outer housing shell 102*a* is received in hollow pivot pin 92. A collar portion 103 of the upper outer housing shell 102*b* of the trailer 27 (see FIG. 1) is received on pivot pin 92 and held down by portions of the inner housing 38 (see FIG. 5).

Figure 7:
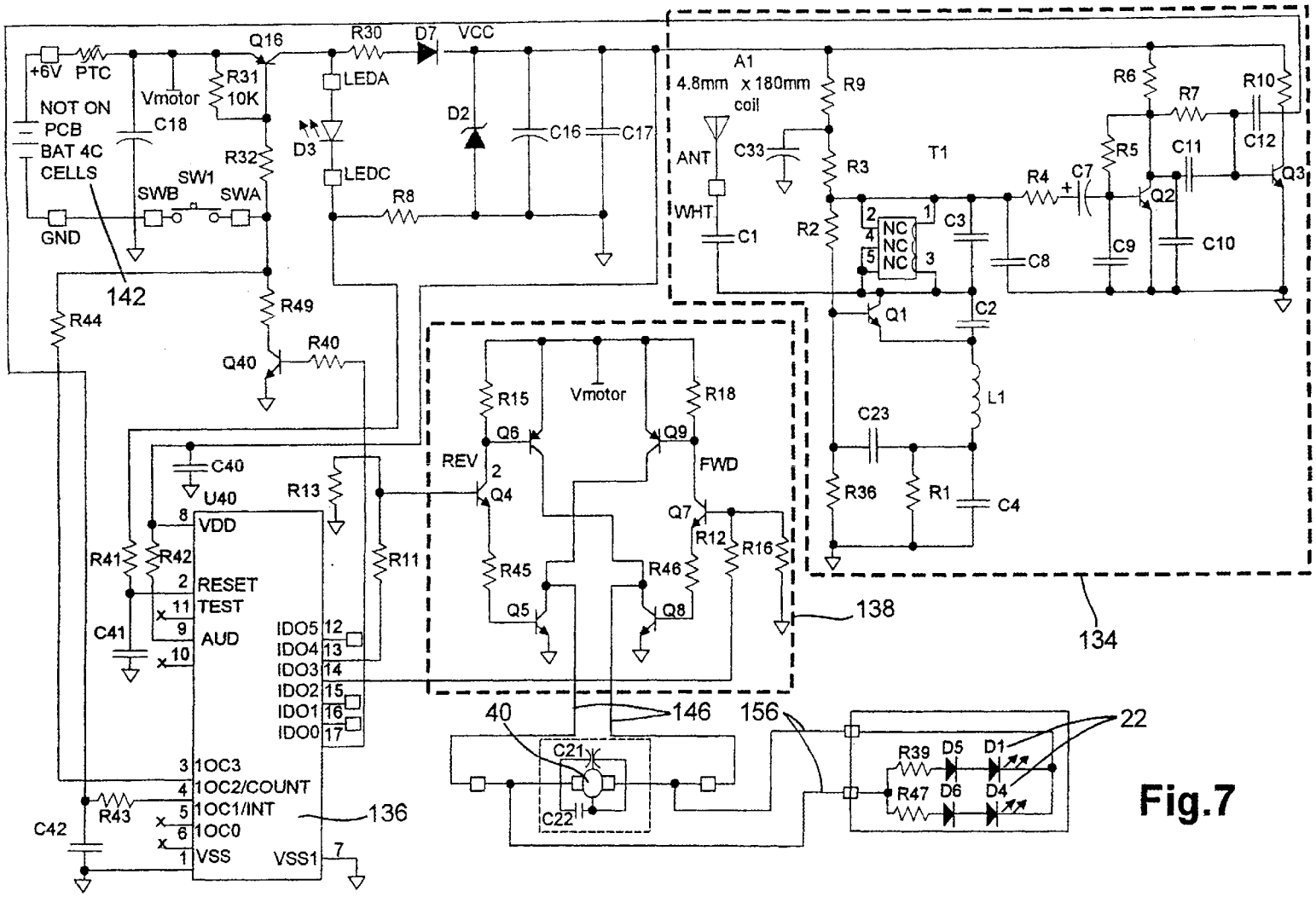
FIG. 7 is a schematic of the electrical circuitry of the snake.

Referring now to FIG. 7, there is shown an exemplary set of components for the circuitry 132 of snake 10. Preferably the circuitry 132 includes a radio frequency receiver circuit 134, a controller 136, and a motor control circuit 138 coupled with the motor 40. A battery power supply 142 powering the entire snake 10 is further indicated. Wiring 146 from the motor control circuit 138 can be extended through a channel in a forward extending tongue of the lower outer housing shell 102*a* and through the hollow pivot pin 92 into the chassis 12. Branch lines 156 can be extended from wiring 146 in the chassis 12 through the neck 16 and to the eyes 22 in the head 20.

Figure 8:
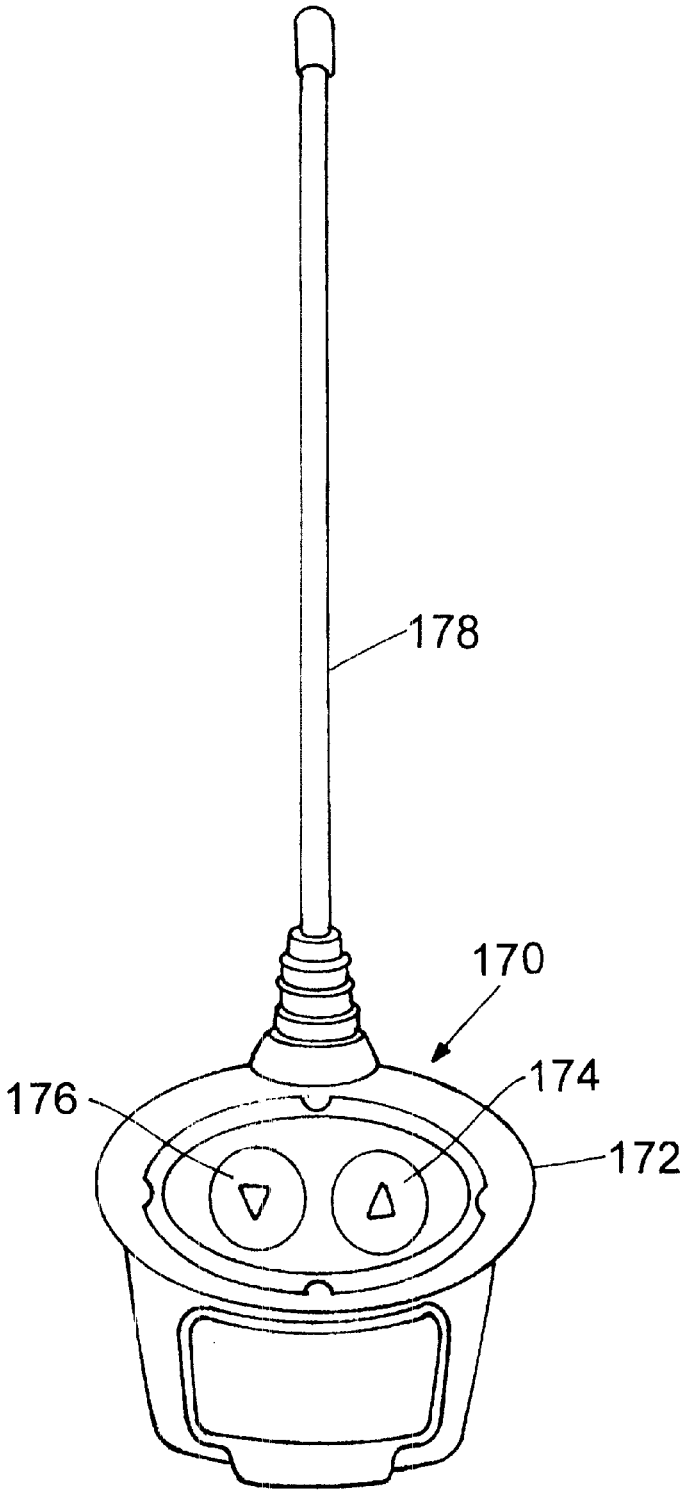
FIG. 8 is an elevation view of a remote control unit.
Figure 9:
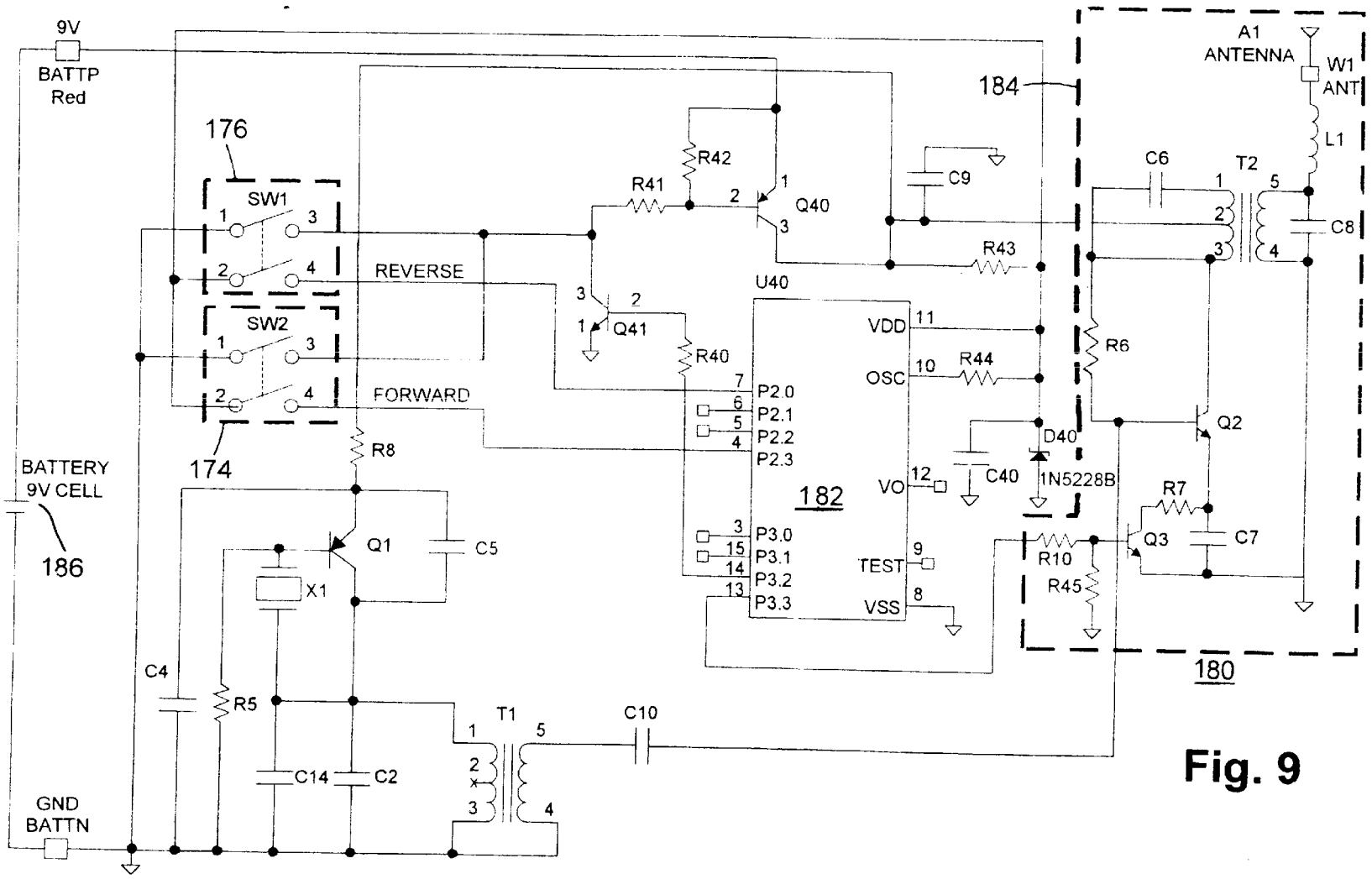
FIG. 9 is a schematic of the electrical circuitry of the remote control unit.

FIG. 8 depicts the remote control unit 170 used with the snake 10. Unit 170 includes a housing 172, a forward control switch 174, a reverse control switch 176 and an antenna 178. FIG. 9 depicts an exemplary circuitry 180 in remote control unit 170. Circuitry 180 includes a control circuit 182, which includes forward and reverse control switches 174, 176, a radio frequency transmitter circuit 184 and the battery power supply 186. Any transmission reception scheme passing two control signals for forward and reverse movement can be used.

The snake 10 is operated as follows. The snake is turned on with the switch 120 and is ready to receive control signals. When the forward command is generated and transmitted by the remote control unit 170 and received and processed by the receiver circuit 134, the controller 136 generates an appropriate control signal sent to the motor control circuit 138 which supplies power from the power supply 142 to the motor 40 which drives the drive wheel 14 in a forward propelling direction. The rack 86 and gear segment 88 pivot collar 90 about a partial arc which the trailer 27 follows by virtue of its pivotal mounting on the pin 92 and its engagement with the detent 91 through pin 106. The remaining tail sections 28–30 are pivotally mounted to freely rotate about the end of the next forward tail section and will follow the side-to-side movement of the rear of the trailer 27 resulting in a generally sinusoidal motion of the tail 18 behind the chassis 12, simulating the slithering movement of a snake. Depending upon the neutral position of rocker arm 60 and the chassis 12, the neck 16 and head 20, which are normally held in an upright or nearly upright position as shown in FIG. 1 may oscillate slightly forward and backward about that position. The snake 10 continues to move forward in a generally straight line as long as the forward control switch 174 is depressed.

When the reverse control switch 176 is depressed an appropriate reverse signal is generated in the remote control unit 170 and transmitted to the snake 10. The controller 136 interprets the received signal and sends an appropriate control signal to the motor control circuit 138, which reverses the power supply to the motor 40 rotating the drive wheel 14 in a reverse direction. Preferably, the reverse motion of the chassis 12 causes the trailer 27 to jackknife as previously described and causes the chassis 12 to turn. This action can be assisted by the provision of a skid 200 on the bottom of the rearmost tail section 30. The skid 200, seen in FIGS. 1 and 2, creates friction which causes the extreme end of the tail 18 to drag along the surface on which the snake 10 is being operated to more quickly cause the trailer 27 to be swung to the side of the chassis 12. The spring 108 holding pin 106 in engagement with the detent 91 is thus forced to disengage. As the chassis 12 continues to move backwards, the drag of the tail 18 causes the chassis 12 to rotate back toward the tail 18 causing the chassis 12 to rotate on the drive wheel 14 as it moves backward and thereby modifying the forward facing direction of the snake 10. When the snake is pointed in a desired direction, the forward control switch 174 can again be depressed causing the snake 10 to move in a new direction.

It will be appreciate by those skilled in the art that changes could be made to the embodiment described above without departing from the broad inventive concept thereof. Applicants hereby incorporate by reference herein in its entirety the disclosure of their earlier U.S. Provisional Application No. 60/181,711, filed on Feb. 11, 2000, Express Mail Label No. EL399091453US. It will thus be appreciated that the motorized snake could have different forms and operate in different manners. It will further be appreciated that the mechanisms for moving the head and/or tail can be varied while still achieving the same comparable oscillating movements. It will further be understood that hard wire control as well as other forms of wireless remote control including sound and light could be used. Finally, it will be understood that this invention is not limited to the particular embodiment disclosed but is intended to cover modifications within the spirit and scope of the present invention as defined by the appended claims.

We claim:

1. A motorized snake comprising: a chassis having a front end and a rear end; at least one ground contacting drive wheel mounted on the chassis; a neck pivotally coupled with the front end of the chassis to pivot forward and back; a multi-section tail including a trailer and at least one follower, the trailer having at least one ground contacting wheel and being coupled with the rear end of the chassis to pivot side to side on the rear end of the chassis, the follower being coupled with the rear end of the trailer distal to the chassis to pivot side to side on the rear end of the trailer; and a motor in the chassis, the motor being drivingly coupled with the at least one drive wheel to rotate the drive wheel to propel the snake and simultaneously with at least one of the neck and the trailer so as to move the neck forward and back on the front end of the chassis or so as to move the trailer side to side on the rear end of the chassis or both.

2. The snake of claim 1 wherein the motor is simultaneously coupled with the drive wheel, the neck and the trailer to move the neck and the trailer as the drive wheel is propelling the chassis.

3. The snake of claim 1 wherein a rearmost follower section of the tail includes a ground contacting skid.

4. The snake of claim 1 further comprising a reduction drive train between the motor and the drive wheel and at least a rocker arm between the reduction drive train and the neck.

5. The snake of claim 1 further comprising a reduction drive train between the motor and the at least one drive wheel and a take-off drive in the chassis operatively coupling the reduction drive train with the trailer.

6. The snake of claim 5 wherein the trailer is coupled to the rear end of the chassis to pivot about a vertical axis and to be operatively coupled with at least a gear segment mounted to rotate about the vertical axis and wherein the take-off drive includes a rack engaged with the gear segment and operatively coupled with the drive train to oscillate the gear segment and the trailer side to side through an arc behind the chassis.

7. The snake of claim 1 further comprising a head pivotally mounted on the neck distal to the chassis and a link coupling the head with the chassis.

8. The snake of claim 7 further comprising a head pivotally coupled with the neck and a link coupled to at least one of the head and the chassis at at least one point removed from the axes along which the neck pivots about the chassis and along which the head pivots about the neck.

* * * * *